US006212721B1

(12) United States Patent
Borodulin et al.

(10) Patent No.: US 6,212,721 B1
(45) Date of Patent: Apr. 10, 2001

(54) OPENER AND STOPPER FOR CRIMPED AND THREADED BOTTLE CAPS

(76) Inventors: German Borodulin, 583 46$^{th}$ Ave., San Francisco, CA (US) 94121; Alexander Shkolnik, 485 Dartmouth Ave., San Carlos, CA (US) 94070

( * ) Notice: Subject to any disclaimer, the term of this patent is extended or adjusted under 35 U.S.C. 154(b) by 0 days.

(21) Appl. No.: 09/550,118

(22) Filed: Apr. 17, 2000

(51) Int. Cl.$^{7}$ ..... B67B 7/00
(52) U.S. Cl. ..... 7/156; 81/3.09; 215/322
(58) Field of Search ..... 81/3.07, 3.09, 81/3.36, 3.4, 3.55, 3.57; 7/151, 156; 215/322

(56) References Cited

U.S. PATENT DOCUMENTS

| | | | | |
|---|---|---|---|---|
| 758,235 | | 4/1904 | Cady . | |
| 959,220 | * | 5/1910 | Hoeft | 81/3.09 |
| 987,268 | * | 3/1911 | Thompson | 215/322 |
| 2,046,804 | * | 7/1936 | Youngblood | 215/322 |
| 2,472,436 | * | 6/1949 | Peterson | 215/322 |
| 2,568,612 | * | 9/1951 | Cullen | 81/3.09 |
| 2,729,125 | * | 1/1956 | Krzanowski | 81/3.09 |
| 3,736,817 | * | 6/1973 | Huff | 7/151 |
| 4,598,435 | | 7/1986 | Borodulin et al. . | |
| 4,607,407 | * | 8/1986 | Bergmeister | 81/3.09 |
| 4,723,465 | * | 2/1988 | Hughes | 81/3.09 |

FOREIGN PATENT DOCUMENTS

2531453 * 2/1977 (DE) ..... 81/3.09

* cited by examiner

*Primary Examiner*—David A. Scherbel
*Assistant Examiner*—Joni B. Danganan

(57) ABSTRACT

A combined bottle opener and stopper comprises a metal plate with side edges bent downward and inwardly. Opening is performed with the use of a conventional pry off method. Opened bottles are closed with a rubber pad attached to the bottom of a recess on the inner face of the plate. The opener-stopper has three bent edges which have different heights with the difference corresponding to the pitch of the thread on a threaded bottle neck. For temporary closing the bottle, i.e., with beer or carbonated water, the device is screwed onto the threaded bottle neck as a nut until the rubber pad is tightly pressed to the upper face of the bottle to hermetically close the latter. For closing bottles with nonthreaded bottle necks, the device is moved onto the bottle neck by guiding the convergent bent edges over the neck in a direction transverse to the bottle's axis until the device is fixed tightly on the bottle due to convergence of the bent edges with the rubber pad, thereby to seal the bottle's opening. The device is also provided with sharp edges for cutting plastic wrappings around the bottle neck and with an opener for metal cans openable by pulling up a tongue connected to a scored can cover.

15 Claims, 2 Drawing Sheets

OPENER AND STOPPER FOR CRIMPED AND THREADED BOTTLE CAPS

BACKGROUND

1. Field of the Invention

The present invention relates to a combined opener and temporary stopper for capped bottles, such as bottles for beer, juice, carbonated beverages, etc. Such bottles have caps, which are held onto the bottle top either by threads which mate with threads on the bottle, or by sealing serrations which crimp the cap around a rim at the bottle's mouth.

2. Description of Prior Art

Known in the art (U.S. Pat. No. 758,235 to C. Cady, Apr. 26, 1904) is a combined opener and stopper (temporary sealer or closure) for bottles with crimp-on caps. The Cady opener and sealer comprises a metal plate having converging side edges which are bent downward and inwardly, a sealing pad made of a resilient material, such as rubber, attached to the inner surface of said plate between the bent edges, and an opening on the wider end of the plate.

The Cady device was used to seal open bottles by sliding the converging edges across the bottle's rim until the sealing pad was pressed and held onto the open mouth of the bottle. The opening in the Cady device was used to remove crimped-on bottle caps as follows: The rear edge of the opening was hooked under the bottom edge of the cap while the front edge of the opening rested on the top of the cap. Then the device was rotated up to pry off the cap.

Such a device was successfully used for many years until a new form of bottle cap appeared on the market, i.e., the threaded bottle cap. The threaded cap in use nowadays comes in two different types, short and tall. The short type, usually is used on beer bottles, has an incomplete or one full turn of thread on the inner surface of the cap with relatively coarse serrations (knurling) on its outside for better grasp and prevention of slippage during unscrewing. The tall type has a greater height and several complete turns of thread and serrations on its upper outside surface. Although both types of threaded caps are designed for removal by simple manual grasping and unscrewing, in practice removal requires substantial force. It is not unusual to see waiters in restaurants and cafes using conventional openers for removing short-height threaded caps from the bottles in the old pry-off fashion. However when this is done, the glass threads sometimes fracture, causing glass debris to fall into the beverage.

Another drawback of threaded bottles is that many conventional openers and stoppers cannot be used for temporarily closing and stoppering bottles because the threads interfere with the stopper. Also threaded caps of the tall type do not have lips on their lower end and fit tightly to the surface of the bottle neck and thus can't be opened with conventional openers.

These disadvantages were eliminated in a bottle closure-opener described in U.S. Pat. No. 4,598,435 issued in 1986 to G. Borodulin, et al. The combined bottle opener and stopper described in this patent comprises a metal plate with opposite side edges bent downward and inwardly. A rubber pad is attached to the flat bottom face of the plate. Teeth are formed on the inner sides of the bent edges for engagement with serrations on the periphery of the cap to be removed. These teeth allow removal of threaded crown caps by unscrewing the caps in the position of engagement between their serrations and the teeth of the opener. The bent edges have different heights with the difference corresponding to the pitch of the thread on a threaded bottle neck. For temporary closing the bottle, i.e., with beer or carbonated water, the device is screwed onto the threaded bottle neck as a nut until the rubber pad is tightly pressed to the upper face of the bottle to hermetically close the latter. For closing bottles with nonthreaded bottle necks, the device is moved onto the bottle neck by guiding the convergent bent edges over the neck in a direction transverse to the bottle's axis until the device is fixed tightly on the bottle due to convergence of the bent edges with the rubber pad, thereby to seal the bottle's opening.

Although this bottle opener and closure has solved some problems of the prior art described above, it is still has some disadvantages. In particular, the pad is attached to a flat inner surface of the opener whereby this pad projects downward for the entire thickness of the rubber pad. This impairs conditions for the fixation of the rubber pad to the inner surface of the opener and requires that the bent side edges have longer height, which, in turn, require that more material to be used for the manufacture of the opener. The rubber pad cannot be reliably secured to the flat surface only by an adhesive and additional bent lugs punched from the body of the opener may be required. This makes the manufacture process more complicated and expensive. The projection of the rubber pad in the inward direction creates inconvenience in placing the opener onto the bottle neck during closing, since the side of projected pad comes into contact with the top edge of the bottle.

The opener of the U.S. Pat. No. 4,598,435 has edges stamped upward from the metal plate. This makes the opener inconvenient in handling, since, when the opener is grasped in a user's hand for using the elements of the inner side, the sharp projections on the outer side will be sensed by the palm of the hand.

Two bent edges are insufficient for reliable engagement with the bottle thread and when a significant force is applied for tightening the opener-closure on the bottle neck, the opener may either come off from the bottle neck or even damage the thread.

OBJECTS AND ADVANTAGES OF THE PRESENT INVENTION

Accordingly, it is an object of the present invention to provide a combined bottle opener and stopper, which has the inner surface free of projections, requires less material for the manufacture, provides more reliable attachment of the bottle-closing rubber pad, is easier to manufacture than the previous model of this type, is convenient in handling and storing, and provides more reliable fixation to the bottle neck when used for bottle closing.

SUMMARY OF THE INVENTION

Figure 1:
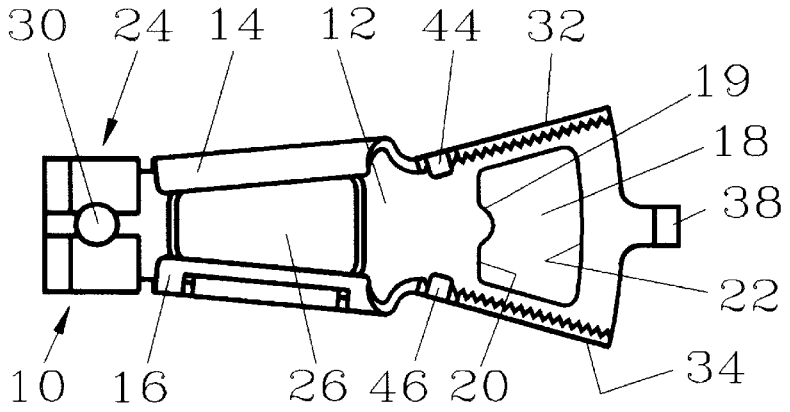
FIG. 1 is a bottom view of a combined bottle opener and stopper according to the invention.

A combined bottle opener and stopper comprises a metal plate with side edges bent downward and inwardly. Opening is performed with the use of a conventional pry off method. Opened bottles are closed with rubber pads attached to the bottom of a recess on the inner face of the plate. The opener-stopper has three bent edges which have different heights with the difference corresponding to the pitch of the thread on a threaded bottle neck. For temporary closing the bottle, i.e., with beer or carbonated water, the device is screwed onto the threaded bottle neck as a nut until the rubber pad is tightly pressed to the upper face of the bottle to hermetically close the latter. For closing bottles with nonthreaded bottle necks, the device is moved onto the bottle neck by guiding the convergent bent edges over the neck in a direction transverse to the bottle's axis until the device is fixed tightly on the bottle due to convergence of the bent edges with the rubber pad, thereby to seal the bottle's opening. The device is also provided with sharp edges for cutting plastic wrappings around the bottle neck and with an opener for metal cans openable by pulling up a tongue connected to a scored can covers.

PREFERRED EMBODIMENT OF THE INVENTION

A combined bottle opener and stopper or temporary closure made according to one embodiment of the invention is shown in FIGS. 1 to 7 and is designated in general by reference numeral 10.

Figure 4:
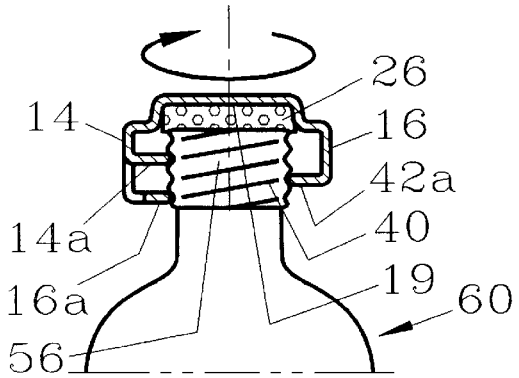
FIG. 4 is a side view illustrating the opener/stopper on a bottle with a threaded neck.
Figure 5:
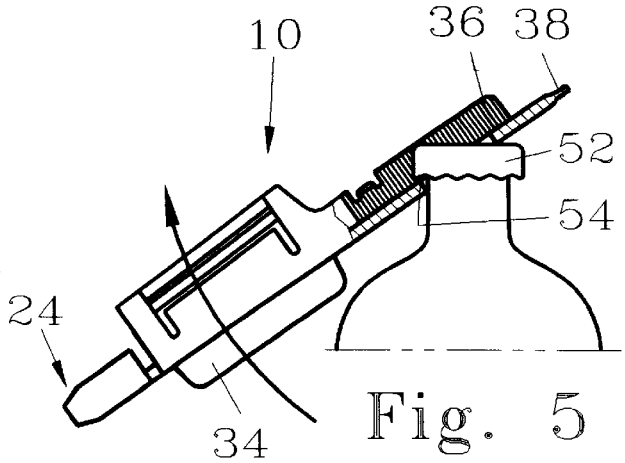
FIG. 5 is a view illustrating the opener/stopper in position for opening bottled with non-threaded caps.

FIG. 1 is a bottom view of the opener/stopper. The opener/stopper comprises a metal plate 12 having a converging shape and side edges 14 and 16 on a portion of its length bent downward and inwardly (FIG. 4).

Figure 3:
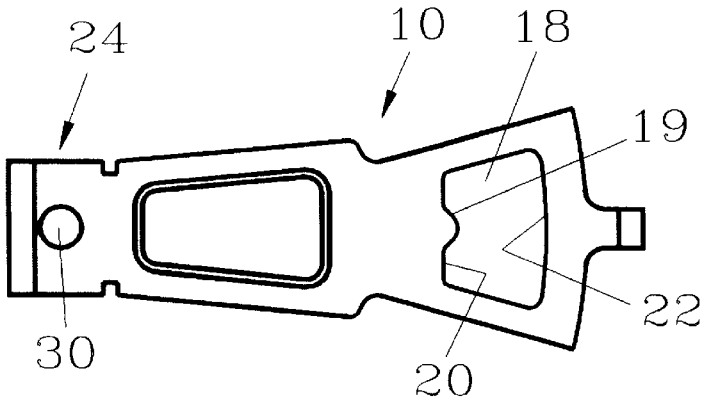
FIG. 3 is a plan view of the device of FIG. 1.

An opening 18, the shape of which is shown in FIGS. 1 and 3, is formed, e.g., by stamping, on the wide portion of plate 12. The width of this opening must be slightly wider than the diameter of the bottle cap and its depth must be sufficient to allow a projection 19 on a rear edge 20 of the opening to be inserted beneath the lip of the cap, with a front edge 22 of the opening resting on the top of the cap. This affords a fulcrum when a rear end 24 of plate 12 is lifted to pry off the cap.

A resilient pad 26 (FIG. 1 and FIG. 2) of rubber or similar material is positioned between bent edges 14 and 16 on the back face of plate 12. This resilient pad is placed into a recess 17 formed in the inner surface 19 (FIG. 4) of plate 12, e.g., by stamping. Resilient pad 26 can be fixed by means of an adhesive (not shown) or, if necessary, by means of bent portions (not shown) of plate 12.

Figure 2:
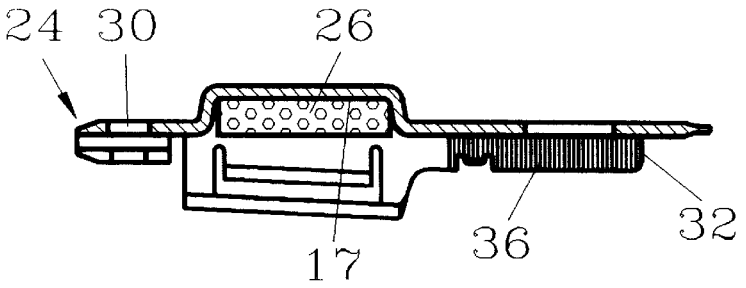
FIG. 2 is a sectional side view of a device of FIG. 1.

As shown in FIG. 2, rear or narrow end 24 of the opener/stopper is formed by two parallel layers 24*a* and 24*b* of sheet metal material with a narrow longitudinal slot 25 between these layers. This construction can be formed by bending lugs (not shown) of a flat sheet metal blank 12. Slot 25 is intended for inserting a tongue T (FIG. 7) for opening canned food containers C which are opened by pulling tongue T upward. The tongue is connected to a scored cover so that when tongue T is pulled up, the can C can be easily opened. Very often, opening of such containers presents a problem since the tongue is made of an aluminum foil stuck to the can surface, so that it is difficult to lift the end of the tongue. In addition, an effort is required to raise the tongue. Especially, this is inconvenient for women who may easily brake a finger nail. The use of the device of the invention significantly facilitates opening of such cans by inserting the tongue T of can C into slot 25 and thus raising the tongue above the can surface.

Rear end 24 has a through opening 30 which may be used for hanging the device on a nail or the like, or for attaching it, e.g., to a key holder (not shown).

Figure 8:
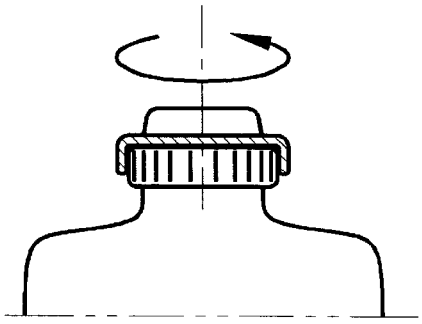
FIG. 8 is a view illustrating the opener/stopper in position for opening bottles with threaded caps having fine serrations on their upper peripheral edge.

Front wide portion of plate 12, which is a continuation of the portion with the edges 14 and 16, also has edges 32 and 34 which are bent downward perpendicular to the plane of plate 12. These edges may have serrations 36 on their inner surface (although only serrations 36 are seen in FIG. 2 on one of the bent edges 32, it is understood that similar serrations are formed on the opposite edge 34). These serrations are intended for friction engagement with serrations on the bottle cap (see FIG. 8).

A screwdriver tip 38 can be formed on the front end of the wider part of the plate 12. This screwdriver can be used for various purposes such as unscrewing the threaded fasteners or for raising the edges of the preserved food caps in order to unseal them from vacuum.

An important feature of the invention is that lower edges 14 and 16 have slightly different height of left edge 14 (FIGS. 4) exceeds the height of the right edge 14 by a pitch of thread 40 on the bottle's neck. A projection 14*a* can be stamped out from one of the edges, e.g., from edge 14. This projection 14*a* is bent downward and to an additional pitch distance of the bottle neck thread in order to engage the next turn of the bottle neck thread, as shown in FIG. 4. This construction provide more firm and reliable attachment of the device of the invention to the threaded bottle neck.

As shown in FIG. 1, the bent edges 14 and 16 have on their ends small sharp projections 44 and 46 for cutting plastic or foil metal wrappings often used for additionally closing the neck of the bottle.

OPERATION OF THE DEVICE OF THE PRESENT INVENTION

The device of the present invention operates in the following manner:

When one desires to open a bottle with a non-threaded cap 52 (FIG. 5), he or she will use the opener/stopper in a conventional manner, i.e., device 10 is placed in a position in which projection 19 on rear edge 20 of opening 18 is beneath lip 54 of cap 52 with front edge 22 of the opening resting on top of the cap. This provides a fulcrum so that when the rear end of plate 12 is lifted, cap 52 will be pried off.

When one desires to remove a threaded cap 56 of the type shown in FIG. 4, opener/stopper 10 is placed onto cap 56 and is moved forward with the wide side so that the bottle cap 56 is wedged between the serrations 36 on the inner surfaced of bent edges 32 and 34. The cap is then removed by unscrewing opener/stopper 10 in the counterclockwise direction.

Figure 6:
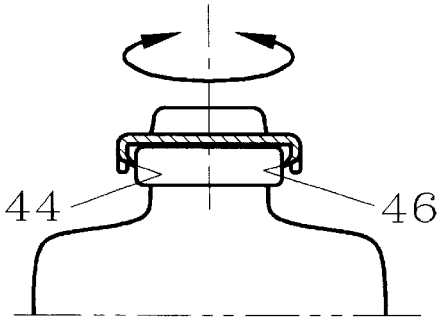
FIG. 6 is a view illustrating the opener/stopper in position for cutting a plastic wrapping around the bottle cap.

Some bottle necks are covered with a plastic or a metal foil wrapping. For removing such a wrapping in order to expose a cork or another bottle stopper, the device 10 can be fit onto the bottle neck as shown in FIG. 6 so that sharp projections 44 and 46 will penetrate into the wrapping. The wrapping then can be cut by rotating device 10 on the bottle.

Figure 7:
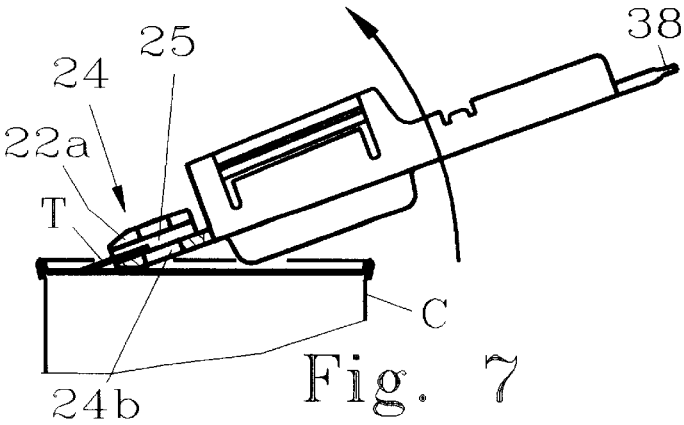
FIG. 7 is a view illustrating the opener/stopper in position for opening cans which are opened by raising and pulling up a tab connected to a prescored can cover.

When one desires to open a can C closed with the scored cover and equipped with a pulling tongue T, the tongue T is into the slot 25 and then the device is moved further to insert the tongue deeper into the slot 25 so that the tongue T could then be easily raised for opening the can. This is shown in FIG. 7.

For temporarily closing or stoppering a threaded bottle 60 (FIG. 4), e.g., with beer or carbonated beverage, the bottle's neck is inserted into the space between edges 14 and 16 and rubber packing 26 until inward projections 14*a*, 16*a*, and 42*a* of bent edges 14, 16 contact the spaces between adjacent turns or threads of the bottle neck. Then the opener/stopper is turned in a clockwise direction (as with a conventional nut) with ends 14*a*, 16*a*, and 42*a* acting as an internal thread of the nut until rubber pad 26 comes into tight sealing contact with the upper surface of the bottle neck, thereby hermetically sealing the bottle. For opening the bottle, opener/stopper 10 is simply unscrewed in the opposite (counterclockwise) direction.

For temporarily closing non-threaded bottles, bent edges 14 and 16 are used as guides which slide over the upper edges of the bottle's neck until the upper face of the bottle appears to be tightly pressed to rubber pad 26. Then opener/stopper 10 will be fixed onto the bottle due to the convergence of edges 14 and 16.

The reader will note that the opener/stopper is universal and easy to use, simple to manufacture, and allows opening and closing of bottles both with threaded and non-threaded caps. It can remove caps of various types and can be used also for opening metal cans such as animal food cans.

We have described the invention in the form of a preferred embodiment. However, those skilled in the art will easily envisage many other modifications and applications. For example, instead of the screwdriver tip 38, another useful element such as a can piercing point can be used. Inward projections can be used instead of serrations 36. The plate itself can be made of metal or plastic. The bottle opener/closure can be manufactured by stamping, casting, or molding. Therefore the scope of the invention should be determined, not by the examples given, but by the appended claims and their legal equivalents.

What is claimed is:

1. A combined bottle opener and stopper for bottle necks of either the type which have a rim for mating with a crimp-on cap or which have male threads with a predetermined pitch for threaded mating with a cap having female threads, comprising:

a plate made of sheet material having upper and lower major surfaces, said plate having converging sides which extend, on a part of the length of said plate, down from said plate for grasping the outer periphery of a bottle cap and also for engaging a rim on a neck of said bottle, the remaining part of said length of said plate having edges bent downward perpendicular to the surface of said plate, the inner surfaces of said edges which are bent downward having means for engagement with said crimped-on caps;

resilient means between said sides on the lower major surface of said plate having an exposed surface hermetically closing the opening of said bottle after said cap is removed, said converging sides having edges which are located at least at three different distances from said lower major surface of said plate, the difference in distances of said edges from said lower major surface corresponding to said predetermined pitch of said male threads on said bottle neck, said sides and edges shaped so as to be able to engage the male threads of a threaded bottle neck so that said opener and stopper can be used to seal the neck of a threaded bottle, said plate having a recess in said lower major surface, and said resilient means being accommodated in said recess so that said exposed surface of said resilient means is in flush with said lower major surface.

2. The invention of claim 1 wherein said sides of said plate comprise integral portions which are bent downwardly and inwardly toward each other so that they can be guided along the neck of said bottle in a direction transverse to the axis of said bottle until tight contact with said resilient means, said converging sides having a narrow end and a wide end.

3. The invention of claim 2, wherein said portions which are bent downwardly are three in number.

4. The invention of claim 3 wherein said plate includes an opening for grasping and removing said crimp-on caps.

5. The invention of claim 4 wherein said plate has a projection on one end, said projection being formed by two parallel layers obtained by bending said sheet material with the formation of a narrow longitudinal slot between said layers for inserting tongues for opening canned food containers by pulling up said tongues.

6. The invention of claim 5, wherein said projection has a through hole for hanging the combined bottle opener and stopper.

7. The invention of claim 6, wherein said narrow end has sharp projections for cutting a material that covers the bottle neck.

8. The invention of claim 4, wherein said narrow end has sharp projections for cutting a material that covers the bottle neck.

9. The invention of claim 4, wherein said means for engagement with said crimped-on caps are serrations.

10. The invention of claim 2, wherein said narrow end has sharp projections for cutting a material that covers the bottle neck.

11. The invention of claim 1 wherein said plate includes an opening for grasping and removing said crimp-on caps.

12. The invention of claim 1 wherein said plate has a projection on one end, said projection being formed by two parallel layers obtained by bending said sheet material with the formation of a narrow longitudinal slot between said layers for inserting tongues for opening canned food containers by pulling up said tongues.

13. The invention of claim 12, wherein said projection has a through hole for hanging the combined bottle opener and stopper.

14. The invention of claim 12, wherein said projection has a through hole for hanging the combined bottle opener and stopper.

15. The invention of claim 1, wherein said means for engagement with said crimped-on caps are serrations.

* * * * *